United States Patent [19]

Haley

[11] Patent Number: 5,062,640

[45] Date of Patent: Nov. 5, 1991

[54] PRACTICE DEVICE FOR GOLFERS

[76] Inventor: Patrick F. Haley, 3529 Caballero La., N. Highlands, Calif. 95660

[21] Appl. No.: 636,448

[22] Filed: Dec. 31, 1990

[51] Int. Cl.[5] ..... A63B 69/36

[52] U.S. Cl. ..... 273/176 F; 273/181 F; 273/185 R; 273/DIG. 30

[58] Field of Search ..... 273/181 R, 181 A, 182 R, 273/176 F, 181 F, 184 R, 185 R, 398–402, 407, DIG. 30

[56] References Cited

U.S. PATENT DOCUMENTS

| | | | |
|---|---|---|---|
| 3,264,001 | 8/1966 | Urban | 273/182 R |
| 3,328,033 | 6/1967 | Hendry | 273/182 R |
| 3,810,616 | 5/1974 | Murphy | 273/181 A X |
| 4,381,110 | 4/1983 | Balaz | 273/181 F |
| 4,905,996 | 3/1990 | Tallent et al. | 273/181 A X |

*Primary Examiner*—George J. Marlo

[57] ABSTRACT

A golf practice apparatus which includes a centrally angled "V" or "U" shaped perimeter framework securing a centrally angled "V" or "U" shaped net wherein the framework extends forward of the target to maintain the angled netting in a secured arrangement in use, thereby creating a receding "V" or "U" shaped backstop. The target is attached to elastic straps which encircle the upper and lower target supports, and supports cross forward of the center framework support. The target is adjustable vertically up or down. A mat is provided which is adjustable horizontally either closer to or away from the target and angled "V" or "U" shaped perimeter framework. The mat is adjustable by supporting it with a board and shims.

7 Claims, 2 Drawing Sheets

PRACTICE DEVICE FOR GOLFERS

FIELD OF INVENTION

This invention relates to the game of golf, specifically to practice, and improvement of the eye had coordination required to play well.

BACKGROUND DESCRIPTION OF PRIOR ART

Golfers traditionally have used golf ranges, and nets, with random targets to practice the game. This device uses a specific target for practice. Thus the golfer receives immediate feedback for correcting his swing.

OBJECTS AND ADVANTAGES

This device is both a practice method and a self-standing game. It can be used both indoors or out, requires only one ball and one club, preferably one of the various Wedges. This device is light and can be transported easily. As a self standing game it can be used year around to maintain game proficiency, and motivation. The player can play as rapidly as he desires. The knowledge gained in practice carries over to the full swing and set of clubs. Further objects and advantages of my invention will become apparent from a consideration of the drawing and ensuing description of it.

PART NAME

10—Screen Support Rings (10)
12—Left side of backstop screen
14—Frame
16—Left elastic target strap
18—Upper target support
20—Center common frame support
21—Foam pipe insulation for center common frame support
22—Right elastic target strap
23—Velcro attaching points
24—Right side backstop screen
26—Lower target support
28—Shows angles to target
30—Target and opening
32—Hitting surface mat

DESCRIPTION

Figure 1:
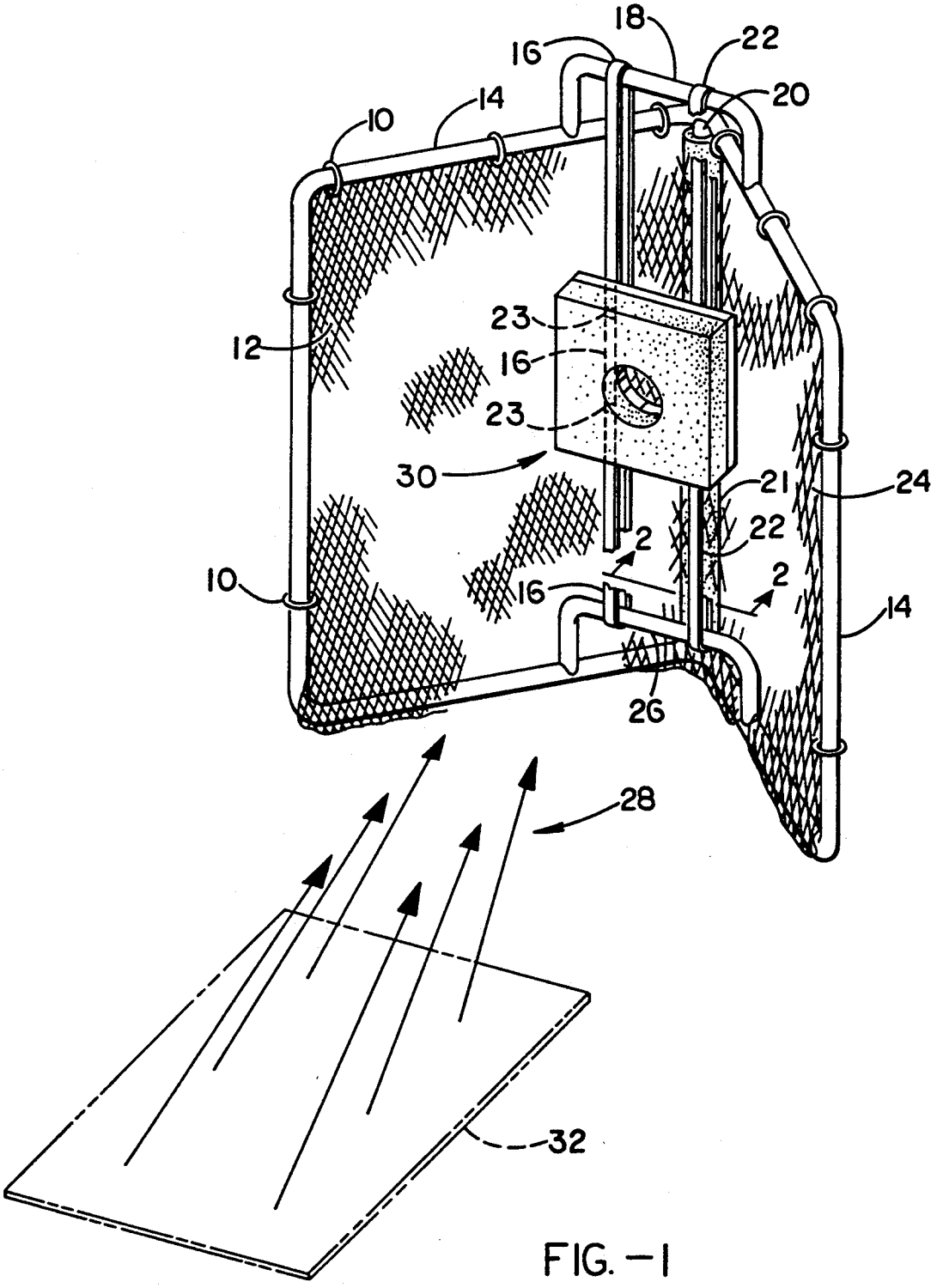
FIG. 1 is a perspective view of the frame supporting the screen rings, screen, target supports, elastic target supports, and target. It also shows the hitting surface with angles from a plurality of hitting areas of the surface.
Figure 2:
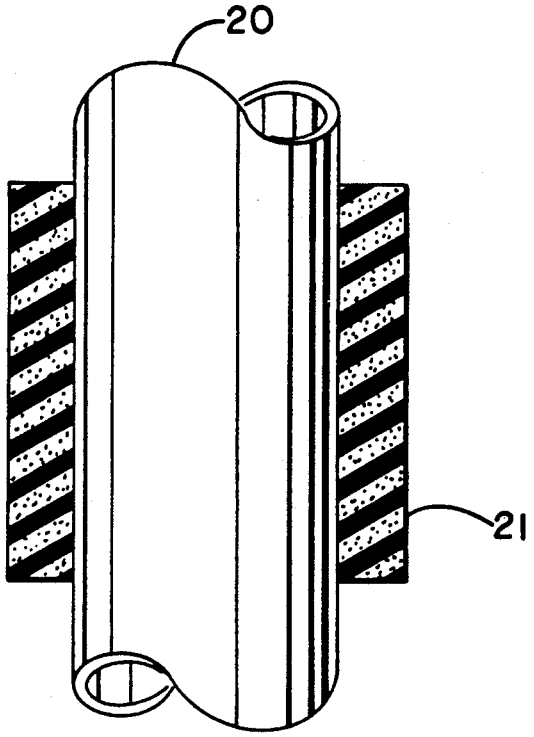
FIG. 2 shows the center common support protected by foam pipe insulation.
Figure 3:
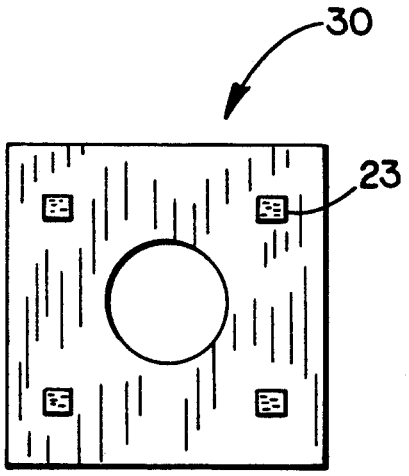
FIG. 3 shows the back of the target showing the Velcro attaching points.
Figure 4:
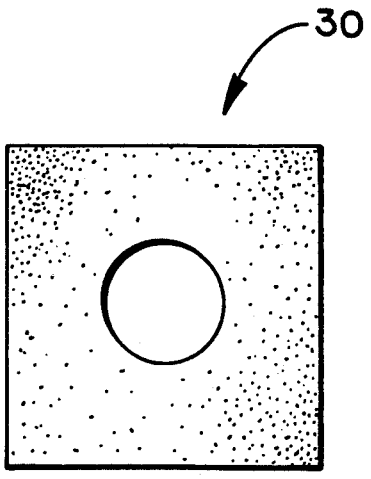
FIG. 4 shows the front of the target showing the foam face.

FIG. 1 shows a perspective view of the support frame, with the center support, and upper and lower target supports. The working model is of ¾ inch P. V. C., pipe, but any material could be used, such as tubing, or wood, or it could be injection moulded. The sides of the frame meet at a 90 degree angle, but that is not an absolute requirement, and they could come together at any functional angle. The target supports cross from left to right on the upper and lower frame structure. Thus leaving an aperture between the target and the frame center support, for the ball to fall through.

Also shown is the backstop screen and the elastic target supports, with Velcro target attaching points. The Velcro attaching points allow the target to be changed to a different size target. The backstop screen can be any form of material, screen, or netting. The purpose of the screen is to prevent the ball from escaping the framed area. The elastic target supports can be any reasonable size. The elastic target supports encircle the upper and lower target supports, and can have a set length by gluing the ends together, or a variable length by attaching the ends with Velcro.

In addition FIG. 1 shows the target and the hitting surface, and its plurality of areas, and angles to the target. All angles can be changed by raising or lowering the target or by moving the hitting surface. By supporting the hitting surface mat in the rear with a board and some magazines, a downhill lie can be created. A uphill lie can be created by supporting the front of the hitting surface mat. And sidehill lies can be created by supporting a side of the mat. The hitting surface can be turf or any form of a mat. The preferred hitting surface is an Astroturf type mat.

The target can be made of laminated cardboard, or sheet plastic. The target has four Velcro attaching points on the back, and a foam face front. The foam front prevents the cardboard, or sheet plastic from disintegrating.

OPERATION OF INVENTION (10) The screen support rings retain the position of the screen during operation. (12) The left side of the backstop screen prevent the ball from escaping the playing area. (14) The frame supports the screen. (16) The left elastic target strap supports the target in its adjusted position. (18) The upper target support, supports the target straps and target and keeps them taunt. (20) The center common frame support, supports the center of the frame. (22) The right elastic target strap, supports the target in its adjusted position. (23) The Velcro target attachments of which there are four, attach the target to the elastic target straps. (24) The right side of backstop screen. (26) The lower target support, supports the target straps and target and keeps them taunt. (28) The lines showing the plurality of hitting areas and their angles to the target. (30) The target surface and opening for the ball to penetrate the target. (32) The hitting surface mat and its plurality of areas.

The two adjustments are: the target can be raised or lowered, and the hitting surface mat can be moved to or from the target.

CONCLUSION, RAMIFICATIONS, AND SCOPE OF INVENTION

Thus the reader can see that the Silent Pro provides a highly reliable, lightweight, yet economical device that can be used by persons of almost any age to improve their golf.

What is claimed as being new and desired to be protected by Letters Patent of the United States is as follows:

1. A golf practice apparatus, comprising:

(a) a frame, (b) a backstop, said backstop supported by said frame, said backstop including a first screen portion and a second screen portion said first and second screen portions being positioned to form a vertical, generally "V" or "U" shaped angle there between;

(c) a target including an opening, said target projecting forward from said backstop junction of said first and second screen portions;

(d) attachment means for flexibly attaching said target to said frame.

2. The apparatus as recited in claim 1, wherein said attachment means comprises elastic straps attached to said frame, said elastic straps coupled to said target.

3. The apparatus as recited in claim 2, wherein said target is detachable from said elastic straps.

4. The apparatus as recited in claim 1, further comprising a mat, said mat having a plurality of hitting areas.

5. A golf ball restraining device, comprising:

(a) a frame, said frame including an upper central target support and a lower central target support:

(b) an accuate-shaped backstop, said backstop supported by said frame;

(c) a target, said target including an opening, said target projecting forward from said backstop and centrally thereof;

(d) a plurality of elastic straps extending between said upper target support and said lower target support; and (e) fastening means for detachably coupling said target to said plurality of elastic straps.

6. The apparatus as recited in claim 5, wherein said fastening means comprises hook and loop fasteners.

7. The apparatus as recited in claim 6, further comprising a mat, said mat having a plurality of hitting zones.

* * * * *